United States Patent [19]

Sansbury

[11] 4,295,840

[45] Oct. 20, 1981

[54] METHOD OF CONSTRUCTING COMPOSITE CONTAINERS

[75] Inventor: Jerry F. Sansbury, Hartsville, S.C.

[73] Assignee: Sonoco Products Company, Hartsville, S.C.

[21] Appl. No.: 957,107

[22] Filed: Nov. 2, 1978

Related U.S. Application Data

[62] Division of Ser. No. 865,799, Dec. 30, 1977, Pat. No. 4,158,425.

[51] Int. Cl.[3] ..... B31C 3/04

[52] U.S. Cl. ..... 493/278; 493/290; 493/294; 493/301

[58] Field of Search ..... 93/94 R, 80, 77 CL, 93/36.01; 156/190, 193, 195; 220/414; 229/4.5; 493/278, 290, 294, 301

[56] References Cited

U.S. PATENT DOCUMENTS

| | | | |
|---|---|---|---|
| 1,993,751 | 3/1935 | Reid | 93/36.01 |
| 2,416,993 | 3/1947 | Grove | 229/4.5 X |
| 3,280,709 | 10/1966 | Elam | 156/190 X |
| 3,376,180 | 4/1968 | Larson et al. | 93/77 CL X |
| 4,055,109 | 10/1977 | Kan | 93/33 H X |

*Primary Examiner*—R. L. Spruill

*Assistant Examiner*—Gus T. Hampilos

*Attorney, Agent, or Firm*—Dennison, Meserole, Pollack & Scheiner

[57] ABSTRACT

A composite container comprising a tubular body formed of spirally wound plies of paperboard or the like and an internal vacuum accommodating liner substantially coextensive with the length of the tubular body and adhesively affixed solely at the opposed ends thereof to the tubular body. The container is completed by the mounting of opposed end caps which are hermetically sealed to the adhesively secured opposed ends of the liner for the accommodation of an internally developed vacuum within the liner. Formation of the tubular body and liner is effected utilizing conventional spiral winding equipment and involves (1) spirally forming a continuous liner with wide bands of adhesive spaced to correspond generally to the length of tube desired, (2) spirally forming a continuous length of composite tubing about the liner, the liner bonding peripherally to the tubing at the adhesive bands, and (3) severing the continuous tubing at a point generally centrally of each adhesive band whereby each formed tube will have the liner thereof adhesively secured solely at the opposite ends.

10 Claims, 8 Drawing Figures

METHOD OF CONSTRUCTING COMPOSITE CONTAINERS

This is a division of application Ser. No. 865,799, filed Dec. 30, 1977, now U.S. Pat. No. 4,158,425, issued June 19, 1979

BACKGROUND OF THE INVENTION

The present invention is generally concerned with composite can construction, and more particularly with a composite can uniquely provided with a hermetically sealable liner for adaptation of the composite can to vacuum packaging. In conjunction therewith, the present invention is also specifically concerned with a unique method of providing the basic composite tubular body with a liner secured solely at the opposed ends thereof for a free inward collapsing, upon being subjected to a reduced internal pressure, independently of the tubular body and without the introduction of adverse forces to the tubular body.

It is now recognized that substantial economies, as well as environmental advantages, can be affected by the use of inexpensive composite containers, as opposed to the traditional glass and metal containers. However, and primarily because of the lack of inherent strength in composite containers, substantial difficulties arise with regard to the packaging of particular products, as well as the use of particular packaging procedures.

This is particularly the case wherein a pressure differential is to be developed between the interior of the container and the ambient atmosphere. More specifically, attempts to vacuum package products within composite containers have, to a large degree, been commercially unsuccessful in that the developed pressure differential causes either an actual or a substantial likelihood of an inward collapsing of the tubular wall. This in turn results, at the least, in an unattractive and potentially unmarketable package, and, in the extreme, in a package whose contents have been exposed and contaminated.

Various and substantial efforts have been put forth with a view toward increasing the potential of composite containers as a universal packaging means. The following U.S. patents constitute the most pertinent known prior art relating to the provision of impermeable or hermetically sealable liners, the particular area of concern with regard to the invention herein.

2,328,798: Gardner
3,383,026: McGee
3,462,063: McGee
3,487,989: Rausing et al
3,662,944: Joosten, Sr.
3,666,163: Ignell
3,799,423: Cvacho
3,978,232: Dodsworth et al
4,010,230: Repenning In each instance, it will be appreciated that the liner is individually formed and mounted within the formed outer tube or the like.

The following U.S. patents are noted as examples of known tube winding procedures and apparatus.

2,301,092: Thompson et al
3,150,575: Couzens et al
3,253,520: Cvacho
3,376,180: Larson et al The patent to Larson et al is of particular interest in that it does illustrate the spiral winding of a container about a separately formed liner. However, the liner in Larson et al is extruded, requiring substantial and elaborate equipment above and beyond that normally associated with the more conventional spiral winding apparatus. Further, the liner in Larson et al is secured to the formed tube throughout the complete extent thereof, providing in effect a completely laminated inner ply.

SUMMARY OF THE INVENTION

The present invention proposes the utilization of conventional spiral winding apparatus so as to continuously form a multilayer composite tubular member containing a continuous liner therein secured at only selected bands spaced along the length thereof and corresponding to the points of severance of the tubular member into the individual container tubes. In this manner, each tubular container body will incorporate an impervious liner secured to the tubular body solely at and peripherally about the opposed end portions thereof. The intermediate portion of the liner, upon the development of a vacuum or negative pressure therein, will, through the pressure differential between the reduced internal pressure and the surrounding ambient pressure, be inwardly drawn against the contents of the container. The only pressures developed on the surrounding tubular body will be at the opposed ends thereof at the points of adhesive attachment of the liner to the tubular body. These opposed ends in turn will be substantially rigidified by the normally provided end caps. In addition, a major portion of the force developed by the inward contracting of the liner will be longitudinal of the tubular body, the direction of the greatest strength thereof. Thus, the final packaged product will in effect be rigidifed by the internally developed negative pressure, as opposed to the more conventional vacuum package where there is an inherent tendency to detract from the structural integrity of the package by an inward drawing of the surrounding walls thereof.

As a variation, it is proposed that the liner, preferably along the seam thereof, include a reverse fold therein so as to provide additional material for a conforming of the liner to the package contents without excessively stretching the liner. The necessity for the provision of this additional liner material will of course vary in accordance with the package contents and the nature of the particular liner material used.

In summary, vacuum packing exerts high external forces against the entire body wall of a can. These high external forces normally require a thick and/or high strength body wall. The present invention provides, and uniquely constructs, what amounts to a flexible hermetically sealable bag suspended within a composite fiber can. When goods are vacuum packed within the bag, the bag conforms to the contents or product generally independently of the can walls, and the forces generated by the vacuum packing are not transferred directly to the can walls. In this manner, thin, lighter and cheaper body wall construction can be utilized. A safety factor is also introduced in that the filled and sealed container is free of any possibility of the body wall imploding.

DESCRIPTION OF THE PREFERRED EMBODIMENT

Figure 1:
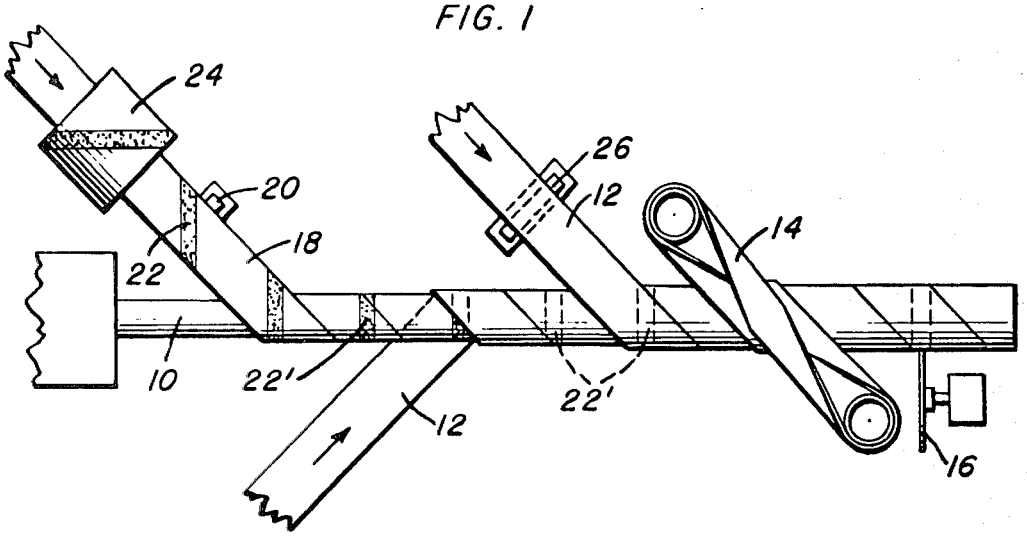
FIG. 1 is a schematic view illustrating the method of the present invention.

The method of the present invention will be understood best from a consideration of FIG. 1 wherein substantially conventional apparatus for the forming of tubular stock, for container bodies or the like, has been illustrated schematically. This apparatus includes an elongated forming mandrel 10, one or more strips of body forming material 12 feeding inwardly from free-wheeling supply rolls (not shown), a driving and winding pulley mounted belt 14, and reciprocating cutter means 16.

The method of the present invention is intended to produce a container body having an impermeable or hermetically sealable liner secured interiorly to the container body solely at the opposed ends thereof with the major length of the liner being free of the body so as to allow an inward contracting of the liner without the introduction of stresses to the container body itself. This construction is achieved using the above apparatus. Basically, a first strip or web 18 of impermeable film is spiral wound on the mandrel 10, this web 18 ultimately defining the liner. The overlapping edges of the lining material 18 are secured together by a suitable adhesive applied to the edges by an appropriate edge engaging adhesive applicator roller 20. In addition, spaced wide angled adhesive stripes 22 are applied to the exterior surface of the liner strip 18 by a patterned adhesive applicator roll 24, fed from a suitable reservoir (not shown), with the orientation and spacing of the stripes 22 being such so as to define a series of circumferential adhesive bands 22' about the wound liner at spacings along the length thereof corresponding to the lengths of the tubular container bodies to be defined ultimately.

The construction of the tubular stock is then completed by the spiral winding of one or more subsequent strips 12 of paperboard or the like. In applying the subsequent strips 12, it will be appreciated that the innermost strip 12, or that applied immediately about the liner strip 18, is provided only with edge bonding adhesive and no adhesive on the inner face thereof whereby a bonding of the innermost strip to the liner is effected solely by means of the adhesive bands 22' defined by the adhesive stripes 22. Any additional strips 12 spirally wound on the initial strip 12 will, as is conventional, be fully bonded thereto, the adhesive being applied by appropriate adhesive applicator rollers 26 fed from appropriate reservoirs.

Figure 2:
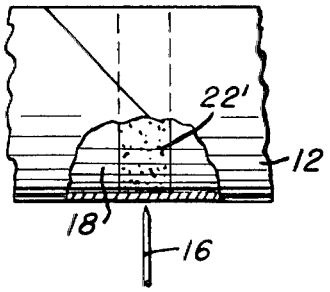
FIG. 2 is an enlarged schematic illustration of the severing of the wound tubular member into the individual tubes or tubular container bodies.
Figure 3:
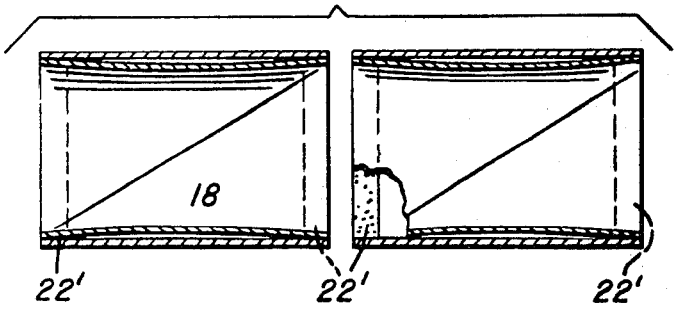
FIG. 3 is a cross-sectional view of a pair of completely severed tubular bodies.
Figure 4:
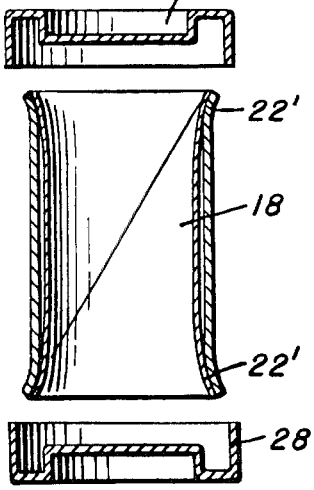
FIG. 4 is a cross-sectional exploded view of a container body and associated end caps prior to a sealing thereof.

The formed stock is rotated and advanced by the driving and winding belt unit 14 to the reciprocating cutting mechanism 16 which cuts the axially advancing stock into container lengths. The actual severing of the tubular stock into container lengths is effected centrally through the adhesive bands 22', as will be best appreciated from the enlarged detail of FIG. 2. In this manner, and also noting FIG. 3, the tubular container bodies each will incorporate a liner having an adhesive band or ring solely peripherally about the opposed ends thereof, with the liner adhesively secured within the container body solely about the periphery of the opposed end portions thereof. The major portion of the liner remains unattached for movement thereof independently of the surrounding structural wall.

The lined tubular container bodies formed in this manner are subsequently processed in a conventional manner so as to flange and/or bead the opposed ends thereof for reception of the opposed end caps 28 at the time of the actual packaging of the product therein.

The end caps 28 will, in defining a vacuum package, be hermetically sealed to the opposed ends of the liner, this being readily effected by conventional means in view of the opposed ends of the liner being adhesively bonded to and coextensive with the opposed ends of the tubular body. Further, inasmuch as the liner has the opposed ends thereof peripherally engaged with the tubular body, it will be appreciated that conventional product loading and capping apparatus can be utilized.

Figure 5:
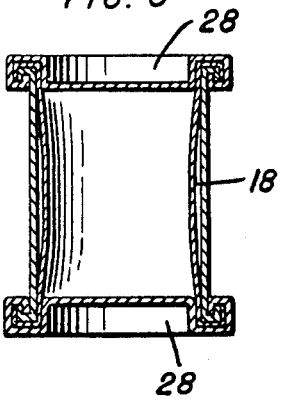
FIG. 5 is a cross-sectional view through a completely packed container.

FIG. 5 illustrates in cross-section the completed and sealed vacuum package. From this figure, it will be appreciated that the vacuum or reduced pressure atmosphere within the liner causes an inward deformation of the liner into compacting engagement with the product substantially independently of the surrounding container body. The stresses, if any, which are transferred to the container body are at the opposed ends thereof which are in turn rigidified by the end caps. Further, a major component of any stresses introduced extends longitudinally of the tubular container body and has no effect on the structural stability of the container. Were, on the other hand, the forces directed laterally inward along the intermediate portion of the tubular body, such as would be the situation were the liner adhesively secured to the container body along the full extent thereof, there would be a substantial danger of imploding. This is particularly the case wherein thin wall low strength composite bodies are used.

Figure 6:
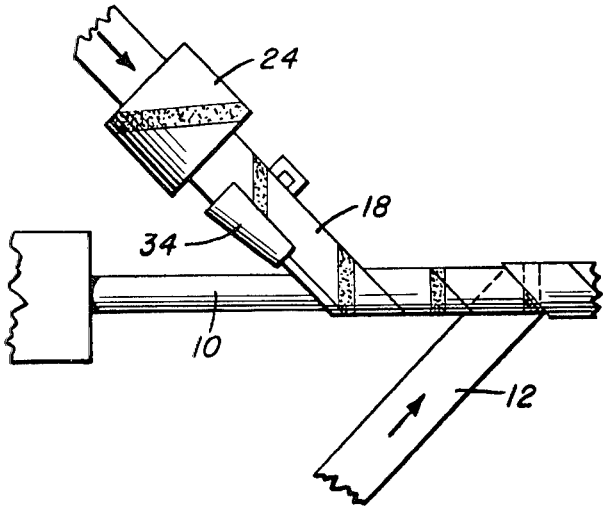
FIG. 6 schematically illustrates the apparatus for introducing and spirally winding the liner wherein a reverse fold is provided along the spiral edge.
Figure 7:
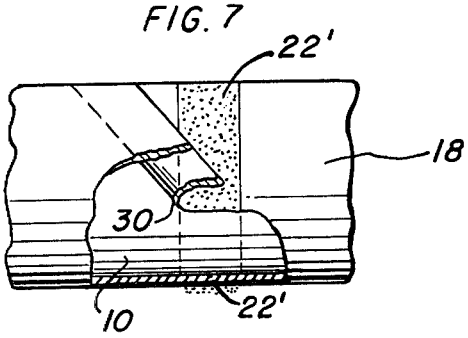
FIG. 7 is an enlarged schematic detail of the folded liner edge.
Figure 8:
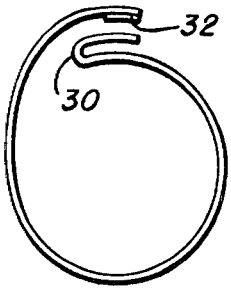
FIG. 8 is a cross-sectional detail through the modified liner incorporating the excess material providing fold.

A variation in the construction of the liner has been specifically illustrated in FIGS. 6, 7 and 8. This variation basically proposes the provision of additional liner material about the inner circumference of the tube so as to, depending upon the nature of the product, facilitate a conforming of the liner to the product without excessively stretching the liner material. This provision of additional material is easily effected by providing a reverse fold or bend 30 within the liner immediately inward of the adhesively secured spiral seam 32. The actual provision of the fold is achieved by the use of a conventional edge folder or plow engaging one edge of the liner material prior to the spiral winding thereof about the forming mandrel 10. In this regard, note the schematic illustration of FIG. 6 with the plow shown at 34.

As will be appreciated, while the opposed ends of the liner within each container will be rigidly secured to both the container body and the opposed caps, the additional material provided by the fold 30 will, along a major portion of the length of the liner, allow for a substantial degree of inward flexing of the liner, under the action of the induced vacuum, for accommodation to the product. In this regard and as previously indicated, the adhesively secured spiral seam 32 of the liner is outward of the fold 30 to allow for the desired free movement of the folded material.

From the foregoing, it is to be appreciated that a unique composite container structure has been devised whereby the basic relatively weak composite container construction has been modified so as to accommodate vacuum packaging without any major variation in the construction of the container, without significantly adding to the cost thereof, and without requiring manufacturing apparatus other than that which is basically conventionally used.

The present invention also involves a unique method of forming the container with a substantially free liner utilizing standard strip winding equipment. The method includes forming tubular stock with an initial winding of liner material having adhesive stripes defined thereon so as to provide bands of adhesive at spaced points for selective engagement with overlying windings of paperboard and the like. The bands are spaced so as to correspond with the lengths of the tubular container bodies with the severing of the tubular stock being effected centrally through each of the bands whereby the liner section associated with each tubular body remains adhesively secured at the opposed ends only.

I claim:

1. A method for forming a lined tubular body of composite construction comprising forming a liner by spirally winding a strip of liner material into a tubular configuration, forming a composite tube about said liner, adhesively securing the composite tube to the liner solely by spaced bands of adhesive about said liner while retaining the liner, between the spaced adhesive bands, free of attachment to the composite tube and capable of movement relative thereto, and severing the composite tube and liner centrally through each adhesive band to define individual tubular bodies with liners secured solely at the opposed ends thereof.

2. The method of claim 1 including the application of spaced adhesive stripes to the strip of liner material prior to the spiral winding thereof, said stripes being oriented to define the spaced bands in the spirally wound liner.

3. The method of claim 2 wherein the composite tube is formed by spirally winding strips of material over the spirally wound liner material.

4. The method of claim 2 including the formation of a longitudinal fold in the liner material prior to the forming of the composite tube about the liner with the fold, along the length thereof, being free of adhesive between the spaced stripes.

5. A method of forming a lined tubular body of composite construction comprising forming a liner of a tubular configuration with spaced adhesive bands about the exterior thereof, forming a composite tube about said liner, adhesively securing the composite tube to the liner solely by the spaced adhesive bands while retaining the liner, between the spaced adhesive bands, free of attachment to the composite tube and capable of movement relative thereto, and transversely severing the composite tube and liner through each adhesive band to define individual tubular bodies with liners secured solely at the opposed ends thereof.

6. The method of claim 5 wherein the liner is formed by spirally winding a strip of liner material into a tubular configuration.

7. The method of claim 6 wherein the composite tube is formed about said liner by spirally winding at least one strip of material about the spirally wound liner material.

8. The method of claim 7 including the application of spaced adhesive stripes to the strip of liner material prior to the spiral winding thereof, said stripes being oriented to define the spaced bands on the spirally wound liner and constituting the only adhesive on the liner.

9. The method of claim 8 including the formation of a longitudinal fold in the liner material prior to the forming of the composite tube about the liner with the fold, along the length thereof, being free of adhesive between the spaced stripes.

10. The method of claim 9 wherein the fold is formed by reversely bending the liner material on itself immediately inward and along one edge of the strip of liner material.

* * * * *